US005642987A

United States Patent [19]

Taricco

[11] Patent Number: 5,642,987

[45] Date of Patent: Jul. 1, 1997

[54] PUMP MOTOR ASSEMBLY FOR A TWO-PHASE FLUID

[76] Inventor: Todd Taricco, P.O. Box 1547, Zephyr Cove, Nev. 89448

[21] Appl. No.: 614,815

[22] Filed: Mar. 8, 1996

[51] Int. Cl.[6] ..... F04B 17/03

[52] U.S. Cl. ..... 417/53; 417/373; 417/423.7; 417/423.8

[58] Field of Search ..... 417/423.8, 423.7, 417/423.11, 373, 372, 366, 367, 53; 62/505; 310/54, 64

[56] References Cited

U.S. PATENT DOCUMENTS

| | | | |
|---|---|---|---|
| 3,256,828 | 6/1966 | Rule | 417/423.11 |
| 3,318,253 | 5/1967 | Campolong | 417/367 |
| 4,621,981 | 11/1986 | Lorett | 417/83 |
| 4,854,829 | 8/1989 | Stanzani et al. | 417/367 |
| 5,256,038 | 10/1993 | Fairman | 417/423.11 |

*Primary Examiner*—Timothy Thorpe
*Assistant Examiner*—Peter G. Korytnyk
*Attorney, Agent, or Firm*—Blakely Sokoloff Taylor & Zafman

[57] ABSTRACT

A pump assembly for a liquefied gas system. The assembly has a housing which contains a seal that separates a motor chamber from a pump chamber. Located within the pump chamber is a pump device that pumps the liquid gas from an inlet port to an outlet port of the housing. The pump device is driven by a motor located within the motor chamber. The assembly includes a heat exchanger that heats any liquid gas that leaks into the motor chamber. The heat exchanger heats the liquefied gas within the motor chamber to a temperature above a critical temperature of the gas, so that the gas does not remove the lubricants from the motor. The heat exchanger can also remove heat generated by the motor to maintain the motor temperature within an operating range.

13 Claims, 1 Drawing Sheet

PUMP MOTOR ASSEMBLY FOR A TWO-PHASE FLUID

BACKGROUND OF THE INVENTION

1. Field of the Invention

The present invention relates to a pump assembly.

2. Description of Related Art

There have been developed "dry" cleaning systems that utilize a liquefied gas such as carbon dioxide ($CO_2$) as a cleaning fluid. Liquefied gas based cleaning systems include a pump that circulates the liquefied gas through a cleaning vessel. Conventional pump assemblies contain a motor that drives a pump device such an impeller. To avoid fluid contamination, the motor is located in a housing chamber external to the impeller of the pump. The pump housing typically has a seal to separate the motor from the liquid gas.

Liquid $CO_2$ is typically pressurized to a level of approximately 800 psi. It has been found that highly pressurized liquefied gas will leak past the pump seal and into the motor chamber. The aggressive cleaning action of the liquefied gas removes the grease and lubricants within the motor, thereby reducing the life of the pump assembly. It would be desirable to provide a liquefied gas pump assembly that prevents the liquefied gas from "cleaning" the motor of the assembly.

SUMMARY OF THE INVENTION

The present invention is a pump assembly for a liquid gas system. The assembly has a housing which contains a seal that separates a motor chamber from a pump chamber. Located within the pump chamber is a pump device that pumps the liquefied gas from an inlet port to an outlet port of the housing. The pump device is driven by a motor located within the motor chamber. The assembly includes a heat exchanger that heats any liquefied gas that leaks into the motor chamber. The heat exchanger heats the liquefied gas within the motor chamber to a temperature above a critical temperature of the liquefied gas, so that the gas does not remove the lubricants from the motor. The heat exchanger can also remove heat generated by the motor to maintain the motor temperature within an operating range.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
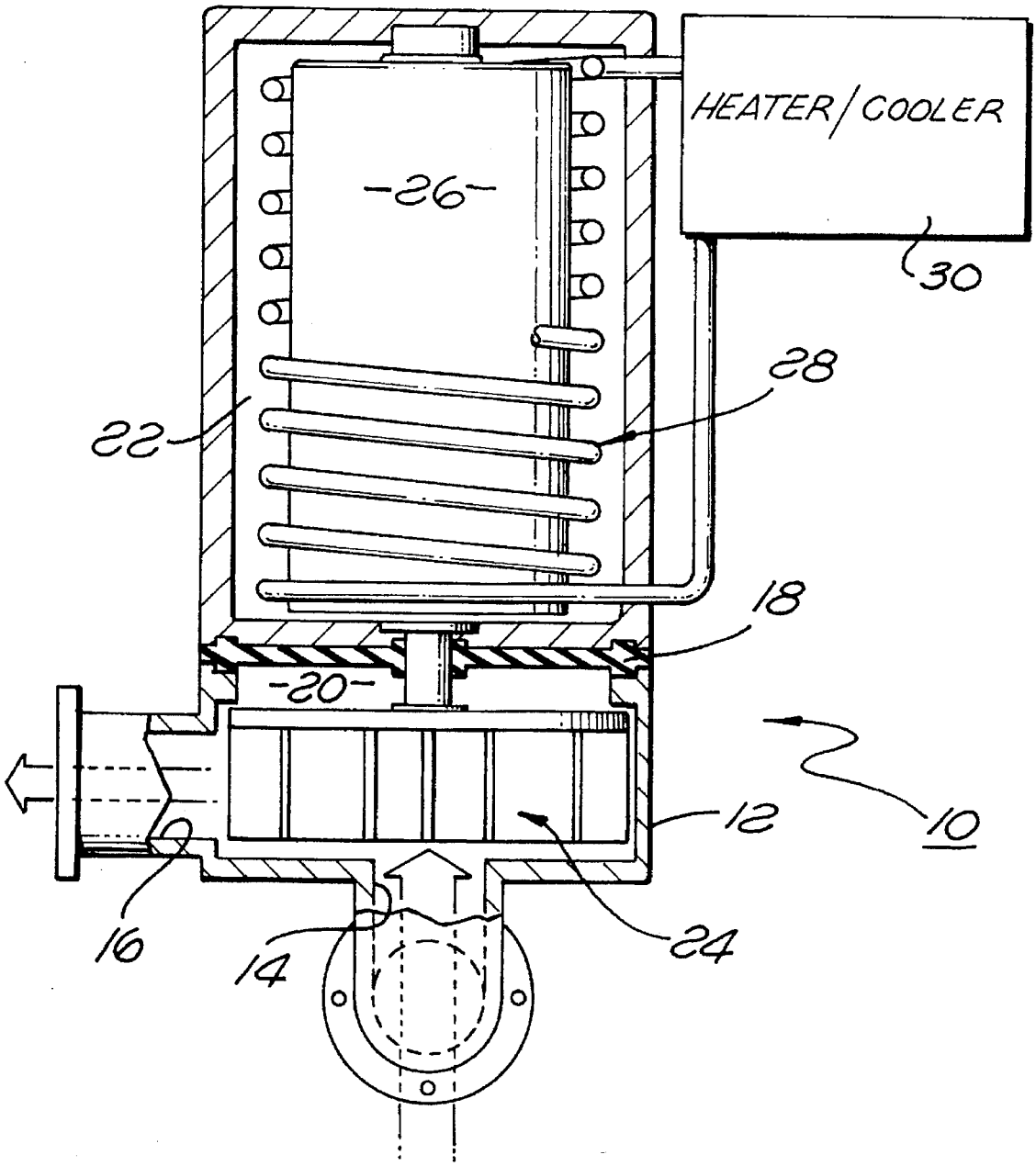
FIG. 1 is a schematic of a pump assembly of the present invention.

Referring to the drawings more particularly by reference numbers, FIG. 1 shows a pump assembly 10 of the present invention. The pump assembly 10 is typically utilized to pump a liquid gas such as a liquefied carbon dioxide $CO_2$. Although a liquid carbon dioxide is described, it is to be understood that the pump assembly 10 may pump other liquid compositions.

The pump assembly 10 includes an outer housing 12 which has an inlet port 14 and an outlet port 16. The inlet 14 and outlet 16 ports are typically connected to the fluid lines of a system. The system may be a "dry" cleaning system that contains the liquid $CO_2$. The housing 12 has an inner seal 18 that separates a pump chamber 20 from a motor chamber 22.

The seal 18 is typically constructed from a conventional flexible non-metallic material such as a synthetic rubber, which both seals and provides a thermal barrier between the chambers 20 and 22.

Located within the pump chamber 20 is a pump device 24 which pumps the liquid gas through the chamber 20 from the inlet port 14 to the outlet port 16. The pump device 24 is driven by a motor 26 that is located within the motor chamber 22. The pump device 24 may be an impeller that is rotated by an electric motor. Although an impeller is shown and described, it is to be understood that the pump device 24 may be any conventional pumping means, including but not limited to, a piston pump, a vane pump, or a diaphragm pump. Likewise, although an electrical motor is described, it is to be understood that the motor may be another device such as an hydraulic motor.

The pump assembly 10 includes a heat exchanger 28 that is located within the motor chamber 22. The heat exchanger 28 is coupled to a heater/cooler unit 30 that can add or remove heat from the motor chamber 22. The heater/cooler unit 30 may receive temperature feedback signals from thermocouples (not shown) connected to the housing 12.

Liquid CO2 is typically circulated at pressures between 600 and 800 psi. At such pressures the liquefied gas tends to leak from the pump chamber 20 to the motor chamber 22 past the seal 18. Liquid $CO_2$ at temperatures above a threshold temperature (approximately 60° F.) and below the critical temperature of the gas composition, has been found to be an aggressive cleaning agent. When introduced to the motor 26, the cleaning characteristics of the liquid $CO_2$ may remove the lubricants of the motor components. The removal of lubricants will rapidly reduce the life of the motor 26.

The heater/cooler unit 30 and heat exchanger 28 provide heat to the motor chamber 22 to raise the temperature of the liquefied gas above the critical temperature, so that the liquefied gas will not aggressively attack the lubricants of the motor 26. The liquefied gas is preferably heated to a vapor state to create a gas blanket about the motor 26. Alternatively, the heater/cooler unit 30 and heat exchanger 28 may lower the liquefied gas temperature below the threshold temperature to reduce the aggressiveness of the gas. During operation of the pump assembly, the heater/cooler unit 30 and heat exchanger 28 can remove heat generated by the motor 26 to maintain the motor temperature within an operating range. Although a single heat exchanger is shown and described, it is to be understood that the pump assembly 10 in an non-illustrated embodiment can have a heat exchanger for heating the gas within the motor chamber 22 and another separate heat exchanger for removing the heat generated by the motor 26.

In operation, the liquefied gas is introduced to the pump chamber 20 through the inlet port 14. Some of the liquefied gas may leak into the motor chamber 22. The heater/cooler unit 30 and heat exchanger 28 heat the liquid gas within the motor chamber to a temperature above the critical temperature of the gas composition. The thermal barrier of the seal 18 prevents any significant heating of the liquefied gas within the pump chamber 22. The motor 26 is activated to drive the pump device 24 and plump the liquefied gas through the pump chamber 22 from the inlet port 14 to the outlet port 16. The heat exchanger 28 and heater/cooler unit 30 remove the heat generated by the motor 26 during the operation of the pump assembly 10 while maintaining the gas above the critical temperature.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method for pumping a liquefied gas, comprising the steps of:

a) providing a pump assembly that includes a housing assembly that has a motor chamber and a pump chamber, said pump chamber being in fluid communication with an inlet port and an outlet port of said housing assembly, a pumping device located within said pump chamber, and a motor that drives said pumping device, said motor being located within said motor chamber;

b) introducing a liquid gas to said pump chamber through said inlet port, wherein a portion of the liquefied gas flows into said motor chamber above a critical temperature of said liquefied gas;

c) driving said pumping device to pump the liquid gas from said inlet port to said outlet port; and, d) heating the liquefied gas within said motor chamber.

2. The method as recited in claim 1, wherein the gas is heated to a vapor state.

3. The method as recited in claim 1, further comprising the step of removing heat from said motor chamber.

4. A pump assembly for pumping a liquefied gas, comprising:

a housing that has a motor chamber and a pump chamber, said pump chamber being in fluid communication with an inlet port and an outlet port of said housing;

a pumping device that is located within said pump chamber and pumps the liquefied gas from said inlet port to said outlet port;

a motor that drives said pumping device, said motor being located within said motor chamber; and, a heat exchanger that is located within said motor chamber and which heats gas that has leaked into said motor chamber above a critical temperature of the gas.

5. The assembly as recited in claim 4, wherein the gas is heated to a vapor state.

6. The assembly as recited in claim 4, further comprising a seal that separates said motor chamber from said pump chamber.

7. The assembly as recited in claim 6, wherein said seal provides a thermal barrier between said motor chamber and said pump chamber.

8. The assembly as recited in claim 4, wherein said pumping device is an impeller that is rotated by said motor.

9. The assembly as recited in claim 4, wherein the liquefied gas is carbon dioxide.

10. A pump assembly that pumps a liquid gas, comprising:

a housing assembly which has a seal that separates a motor chamber from a pump chamber, said pump chamber being in fluid communication with an inlet port and an outlet port of said housing assembly;

a pumping device located within said pump chamber, said pumping device pumping liquid gas from said inlet port to said outlet port;

a motor that drives said pumping device, said motor being located within said motor chamber; and, a heat exchanger that is located within said motor chamber and which heats a liquefied gas that has leaked into said motor chamber to a temperature above a critical temperature of the gas.

11. The assembly as recited in claim 10, wherein the liquefied gas is heated to a vapor state.

12. The assembly as recited in claim 11, wherein said seal provides a thermal barrier between said motor chamber and said pump chamber.

13. The assembly as recited in claim 12, wherein said pumping device is an impeller that is rotated by said motor.

* * * * *